United States Patent [19]

Craven, Jr.

[11] Patent Number: 4,602,773

[45] Date of Patent: Jul. 29, 1986

[54] EXTREMITY DEBRIDEMENT TROUGH

[76] Inventor: Thomas Craven, Jr., Rte. 3, Box 327CC, Wilmington, N.C. 28403

[21] Appl. No.: 672,680

[22] Filed: Nov. 19, 1984

[51] Int. Cl.[4] ..... A61G 13/00

[52] U.S. Cl. ..... 269/328; 269/327; 604/356; 5/443

[58] Field of Search ..... 269/15, 322, 323, 327, 269/328; 5/443, 503; 604/355, 356, 357; 128/132 D

[56] References Cited

U.S. PATENT DOCUMENTS

| | | | |
|---|---|---|---|
| 4,054,282 | 10/1977 | Hamer | 269/328 |
| 4,221,371 | 9/1980 | Kuphal | 604/356 |
| 4,243,214 | 1/1981 | La Rooka | 269/327 |

*Primary Examiner*—Frederick R. Schmidt

*Assistant Examiner*—Judy J. Hartman

*Attorney, Agent, or Firm*—Mills and Coats

[57] ABSTRACT

The present invention entails an extremity debridement trough for receiving and holding an arm or leg extremity of a patient. A trough structure is supported by a mobile frame structure including an adjustable vertical member connected to the trough. The trough is pivotally mounted above one end area to said vertical member of said mobile frame structure and is movable from a generally horizontal operative position to an inoperative vertical position for storage or transport. A sterile field is provided by a disposable plastic liner held within said trough and formed into a funnel about a remote end of the trough. Used cleaning solution used in cleaning a wound on or about an extremity of a patient is allowed to drain from the formed funnel into an underlying container.

12 Claims, 4 Drawing Figures

EXTREMITY DEBRIDEMENT TROUGH

FIELD OF INVENTION

The present invention relates to medical and surgical apparatuses, and more particularly to an extremity debridement table or trough adapted to be used in conjunction with an operating table especially useful to hold and support a wounded arm or leg extremity in a sterile field while the same is being cleaned a debridement is being carried out.

BACKGROUND OF INVENTION

Prevention of wound sepsis in severe extremity wounds, especially compound fractures, depends on initial adequate wound care consisting of scrupulous wide cleaning of the extremity, and meticulous debridement of devitalized tissue and extensive wound lavage. In order to carry out such wound treatment it is necessary to place the wound in a sterile field. Moreover it is highly desirable to position and support the wound and extremity in a convenient location, a location where the surgeon and others rendering surgical care can easily and conveniently reach the area of concern. Still further it is desirable to manage the used dirty wound cleaning solution after the same has been used to clean and sterilize the wound.

Presently there does not appear to be a commercially available apparatus or table especially designed to be used in conjunction with an operating table for receiving and holding a wounded extremity and positioning the wounded extremity in a sterile field. Thus the surgeon and his staff have had to use whatever apparatus or table type structure is available, and then to adapt such as best as possible to yield a sterile field and to position the wounded extremity in a position where the same can be treated.

SUMMARY AND OBJECTS OF THE PRESENT INVENTION

The present invention entails a medical support structure especially designed for receiving and supporting a wounded extremity, such as an arm or leg, while wound care is administered. More particularly, the medical support structure of the present invention is referred as an extremity debridement trough as the same includes a debridement trough means having one open end through which a patient's extremity is inserted into the debridement trough. A sterile field is provided by a plastic disposable liner held within the trough and positioned underneath the patient's extremity. Further, the disposable plastic liner is extended out the end of the debridement trough means opposite the end through which the patient's extremity is inserted. About this end, the disposable plastic liner is formed into a funnel structure and the formed funnel structure depends downwardly from that end of said debridement trough means and acts to channel used cleaning solution to an underlying container.

The extremity debridement trough is pivotly mounted to a vertical post or member which in turn is secured to a lower frame structure that is provided with wheel means in order that the entire structure can be conveniently moved from one location to another. The debridement trough means can be pivotly moved from an operative horizontal position to an inoperative vertical position and in the inoperative vertical position the apparatus of the present invention can be stored or transported from one location to another.

It is therefore an object of the present invention to provide an extremity debridement trough that is especially designed to receive and support a wounded extremity of a patient, and to support that extremity while various wound care practices and techniques are being carried out.

A further object of the present invention is to provide an extremity debridement trough of the character referred to above that is designed to work in conjunction with an operating table.

More particularly, a further object of the present invention resides in the provision of an extremity debridement trough that is specifically designed to extend from and to be supported from an operating table such that while a patient is disposed on the operating table a wounded or injured arm or leg extremity may be projected from the operating table onto the debridement trough.

A further object of the present invention resides in the provision of an extremity debridement trough that is provided with a sterile field.

Another object of the present invention resides in the provision of an extremity debridement trough or apparatus of the character referred to above wherein the provision of the sterile field is accomplished by a disposable plastic liner that is designed and adapted to be held within the trough structure of said debridement trough.

It is also an object of the present invention to provide an extremity debridement trough of the character referred to above wherein the disposable plastic liner includes a portion that is formed into a funnel structure and wherein the funnel structure is adapted to direct used or dirty cleaning solution that has been used in conjunction with cleaning and sterilizing the wound to an underlying container.

Still a further object of the present invention resides in the provision of a extremity debridement attachment that is provided with a mobile frame in order that the extremity debridement trough or apparatus can be conveniently moved from one location to another.

It is also an object of the present invention to provide an extremity debridement trough of the character referred to above that can be folded from a operative position to an inoperative position where in the inoperative position the extremity debridement trough or apparatus can be conveniently transported and moved from one location to another.

Another object of the present invention resides in the provision of an extremity debridement trough of the general character discussed above wherein in said inoperative or transport position, the extremity debridement trough takes on a cart like character.

It is also an object of the present invention to provide an extremity debridement trough of the character referred to above that includes a disposable sterile field which enables the extremity debridement trough of the present invention to be used by one patient after another without the same being required to be cleaned and sterilized.

A further object of the present invention is to provide a medical support apparatus of the basic character discussed above that has a variety of routine medical uses including use in the emergency room as a stable arm or leg board as well as a cleansing device which can be used in the emergency room for cleaning compound wounds or routine pre-operative extremity preparation.

A further object of the present invention resides in the provision of a medical support structure of the character discussed hereinabove that is of a light weight construction, is relatively simple in design, easy to manufacture, and durable.

Other objects and advantages of the present invention will become apparent from a study of the following description and the accompanying drawings which are merely illustrative of such invention.

EXTREMITY DEBRIDEMENT TROUGH

Figure 1:
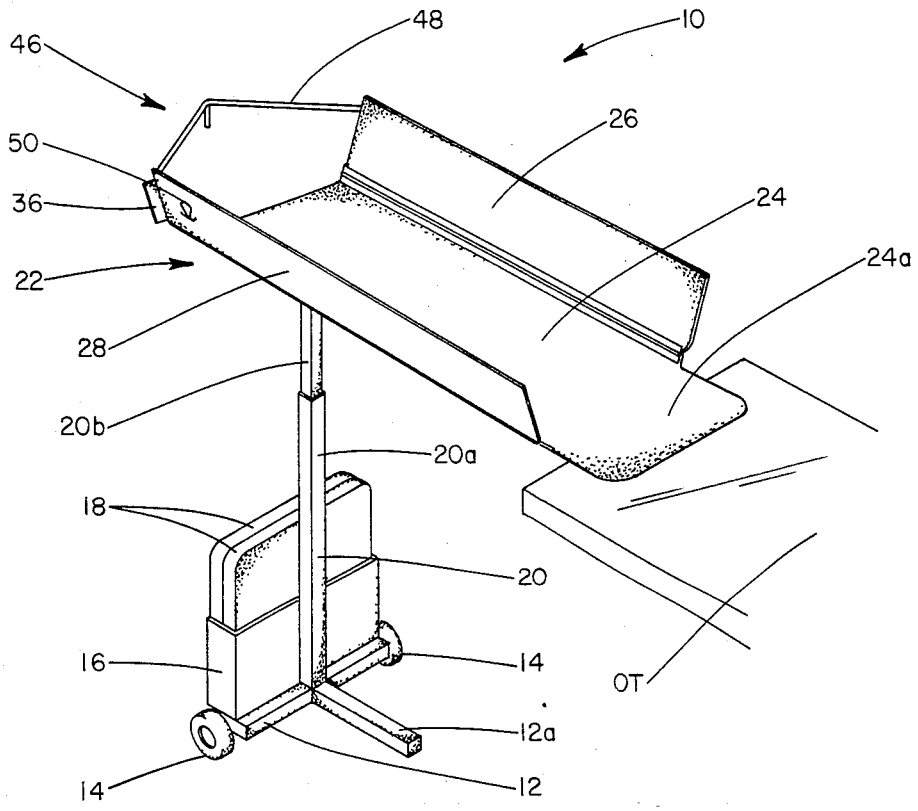
FIG. 1 is a perspective view of the extremity debridement trough of the present invention disposed in an operative horizontal position.

With further reference to the drawings, the extremity debridement trough of the present invention as shown therein and indicated generally by the numeral 10.

Viewing extremity debridement trough 10 in detail, it is seen that the same includes a lower T-shaped frame structure 12 which includes a balancing leg 12*a*. Lower T-shaped frame structure 12 includes a pair of wheels 14. In addition there is formed on lower T-shaped frame structure 12 a carrying case 16 that may be used to transport and hold selected articles such as cushions 18.

Secured to lower T-shaped frame structure 12 is an adjustable vertical support 20. Vertical support 20 is of a two piece construction and includes a lower hollow member 20*a* that has an upper telescoping member 20*b* movably contained therein. Upper member 20*b* can be vertically adjusted within lower member 20*a* by appropriately adjusting a set screw 21 threadedly secured within lower member 20*a* and particularly shown in FIG. 4.

Lower T-shaped frame structure 12 and vertical support 20 are adapted to support a debridement trough means indicated generally by the numeral 22. Viewing debridement trough means 22 in detail, the same includes a generally flat bottom 24 that includes a pair of upturned side edges 24*b* and 24*c* as particularly shown in FIG. 4. In addition, there is provided a bottom extension 24*a* that extends outwardly from one end of the debridement trough means 22, that end being referred to as an extremity insert end. Pivotly mounted to each of the upturned side edges 24*b* and 24*c* of bottom 24 is a pair of side walls 26 and 28. The respective side walls 26 and 28 are secured to the upturned side edges 24*b* and 24*c* through a hinge assembly 30. The respective side walls 26 and 28 include lower tab extensions 26*a* and 28*a* that extend below the level of the respective hinge assembly 30. These extension tabs effectively limit the outwardly pivotable movement of the respective side walls by engaging the outside of the respective upturned side edges 24*b* and 24*c* of bottom 24. As will be appreciated from subsequent portions of this disclosure, the respective side walls 26 and 28 can be pivoted inwardly to an inoperative position adjacent the top of bottom 24, as illustrated in FIG. 2.

With reference to the end of said debridement trough means 22 opposite bottom extension 24*a*, it is seen that there is provided a handle plate 32 that extends downwardly from the terminal end of bottom 24. Handle plate 32 includes a handle opening 34 that allows the extremity debridement trough 10 to be pulled when the same is disposed in a transport mode, such as illustrated in FIG. 2. In addition, about the same end of debridement trough means 22 there is provided a pair of ears 36 and each of the ears extend outwardly from the end of the respective side walls 26 and 28 and extend in a plane generally normal to the plane of the side walls.

Figure 2:
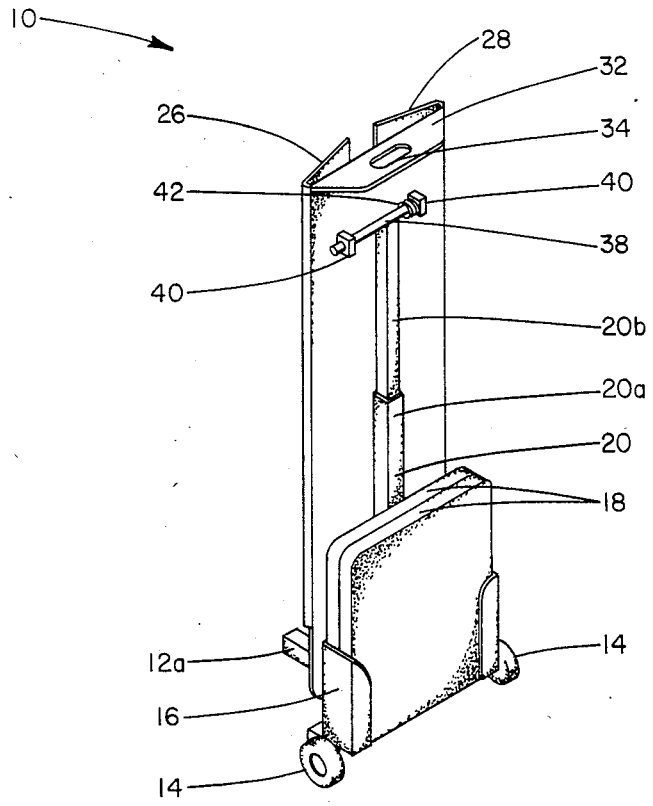
FIG. 2 is a perspective view of the extremity debridement trough of the present invention shown in its inoperative vertical position where the same, because of its portable nature, can be moved one location to another.

As appreciated from studying FIGS. 1 and 2, debridement trough means 22 is pivotly mounted for movement between a generally horizontal operative position (FIG. 1) to an inoperative vertical position (FIG. 2). To provide for this pivotable movement, the upper portion of upper member 20*b* is provided with a pivot pin 38 that is journaled within two spaced apart ears 40 secured to the underside of bottom 24. In addition, as seen in FIG. 2, pivot pin 38 can be provided with a torsional type spring that can absorb a portion of the load attributable to said debridement trough means 22 when the same is not supported about bottom extension 24*a*.

Figure 3:
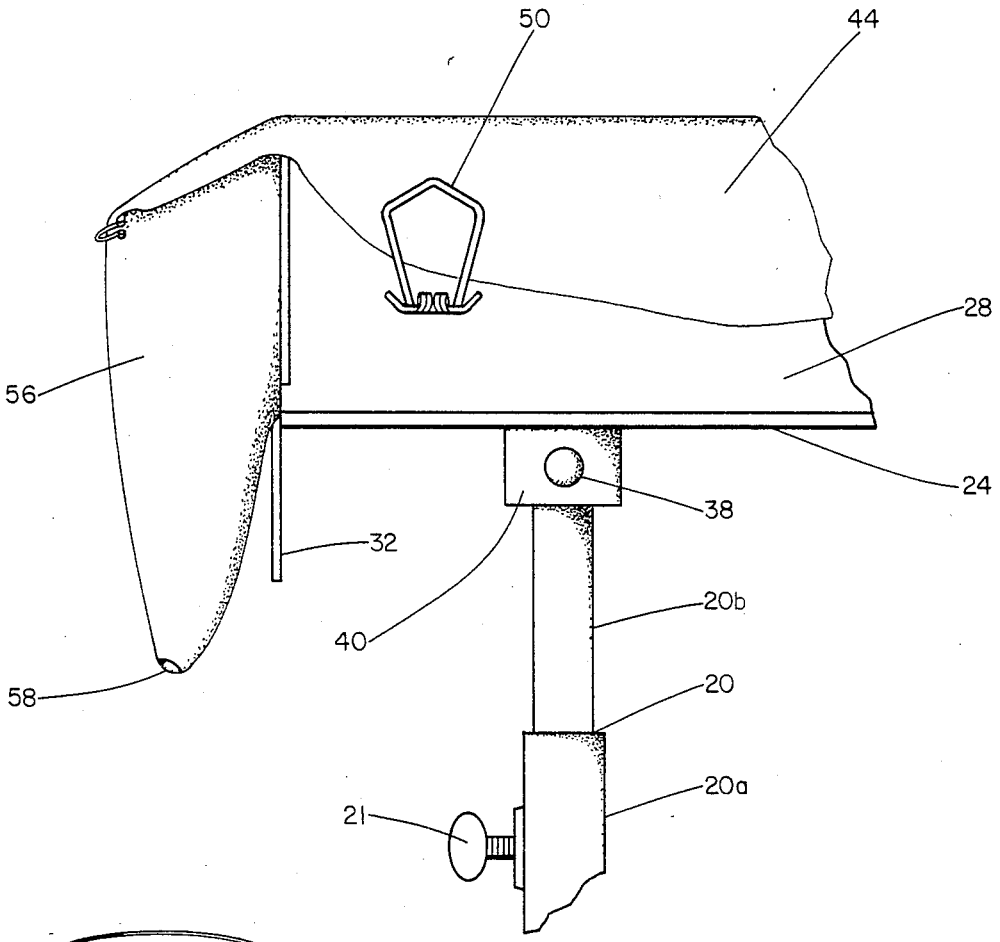
FIG. 3 is a fragmentary side elevational view showing the disposable plastic liner that forms the sterile field for the extremity debridement trough formed into a funnel structure for channeling used clean solutions from the extremity debridement trough.

Debridement trough means 22 is designed to accept and support a sterile field. In order to accomplish this, the present invention provides a disposable plastic liner 44, as seen in FIG. 3, that is adapted to be laid and held within debridement trough means 22. Disposable plastic liner 44 should be impervious in order that the same can hold and contain a fluid cleansing and sterilizing solution that may be used in the treatment of a wound.

It is desirable for the disposable plastic liner 44 to be shaped into a funnel structure about the end of debridement trough means 22 opposite bottom extension 24*a*. The formed plastic funnel structure is referred to by numeral 56 in FIG. 3 and the same includes an opening 58 that overlies a bucket B.

Figure 4:
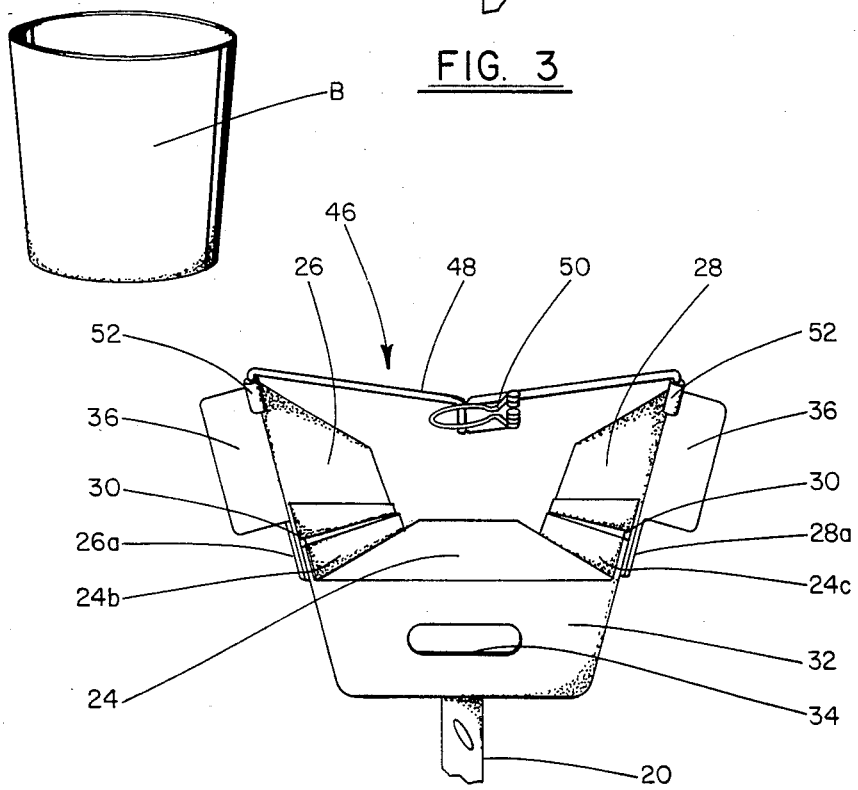
FIG. 4 is a fragmentary end elevational view showing the extremity debridement trough from the end remote from the open end wherein the patient's extremity is inserted.

In order to form the plastic bag type funnel 56, debridement trough means 22 is provided with a funnel frame support structure indicated generally by the numeral 46 and again disposed about the end of debridement trough means opposite the extremity insert end. Viewing the funnel frame support structure 46, as seen in FIGS. 1 and 4, the same comprises a V-shaped member 48 that extends outwardly from the funnel end of debridement trough means 22. V-shaped member 48 includes a pair of turned ends that are received by a pair of inserts 52 that are secured to the end of the respective side walls 26 and 28. In addition, V-shaped member 48 as well as the outside areas of the side walls 26 and 28 and bottom 24 includes springs biasing clips 50. These clips 50 function to engage the plastic disposable impervious liner 44 and to secure the same about the debridement trough means 22. It is appreciated that V-shaped member 48 serves to receive and support a portion of disposable plastic liner 44 such that the same can be draped downwardly therefrom to form the plastic funnel structure 56.

In use, the extremity debridement trough 10 of the present invention is positioned in its operative horizontal position as shown in FIG. 1. Herein the debridement trough means 22 assumes a generally horizontal position and extends onto an operating table 0.T. or some other support structure that will effectively support the entire debridement trough means 22 in a generally horizontal position that would preferably be inclined downwardly towards the funnel end thereof. Next, the disposable impervious plastic liner is inserted into the debridement trough means 22 and draped back over each of the side walls 26 and 28 and secured thereat by the various spring clips 50 formed about the outside of the debridement trough means 22. In addition, the disposable plastic liner 44 is extended outwardly from the funnel end of the debridement trough means 22 as illustrated in FIG. 3. Here the plastic liner 44 is draped and secured about V-shaped member 48 to form said bag type funnel 56 and the same is positioned over a bucket B.

A patient's extremity to be treated, such as his or her arm or leg, is inserted into the open end of debridement trough means 22. Here any wound found on the extremity is cleaned and sterilized and other wound treatment is administered. It is appreciated that the used cleaning solution will drain from the debridement trough means 22 into the bag type funnel 56 and from there into bucket B.

Once the patient's wounds have been appropriately treated, then the patient's extremity is removed from debridement trough means 22, and the sterile field in the form of the disposable liner 44 is discarded. Respective side panels 26 and 28 can be folded inwardly adjacent the top of bottom 24 by removing the V-shaped member 48. At that time, the debridement trough means 22 can be pulled from the operating table 0.T., and pivoted to its inoperative transport position, shown in FIG. 2. At this time, an individual can engage handle opening 40 and the entire extremity debridement trough 10 can be pulled to a storage location.

It should be appreciated that the medical apparatus and extremity support structure just described can accommodate a variety of uses within a hospital or medical facility. The same can be used as a simple support board for an extremity, or can be used in pre-operative preparations, as well as cleaning and caring for any type of wound found on an individual's extremity.

From the foregoing specification and discussion, it is appreciated that the present invention presents a very useful and efficient medical support structure that is particularly designed to be extremely useful when used in conjunction with a support table or operating table in order to clean and treat wounds found on individual's extremities. Of particular importance is the fact that the present design is very simple and that the entire structure is highly portable and can easily and conveniently be moved from one location to another.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended Claim are intended to be embraced therein.

What is claimed is:

1. An extremity debridement trough for receiving and holding a wounded extremity of a patient while the wounded extremity is cleaned and treated in a sterile field; said extremity debridement trough comprising:

a. debridement trough means for receiving and holding a wounded extremity of a patient;

b. said debridement trough means including a bottom and opposed side walls pivotally mounted to said bottom from to a trough like structure wherein said side walls are movable from an operative generally upstanding position inwardly to an inoperative position generally overlying said bottom;

c. said debridement trough means further including an extremity insert end that includes an opening formed about one end of said debridement trough means for allowing an extremity of a patient to be inserted therethrough onto said extremity debridement trough means and a funnel end for allowing cleaning and irrigation solution to be drained;

d. stop means for limiting the outward pivotal movement of said side walls once said side walls assume an operative upstanding position;

e. a funnel support structure extending outwardly from said funnel end of said debridement trough;

f. vertical support means secured to said extremity debridement trough and extending downwardly therefrom to a support surface such as a floor for supporting said extremity debridement trough above the support surface;

g. sterile field means normally held and disposed within said debridement trough means about the bottom thereof and between the opposed side walls thereof for underlying an extremity of a patient contained therein and for holding and confining a wound cleaning and irrigation solution used in cleaning the wound of the extremity; and h. said sterile field means including an impervious disposable plastic liner that is supported by said extremity debridement trough means and which generally lies therein with the patient's extremity supported thereon, said plastic liner including a funnel portion having an outlet depending downwardly from said funnel support structure for directing said cleaning and irrigation solutions to a container disposed thereunder.

2. The extremity debridement trough of claim 1 wherein said funnel support frame structure includes a rigid frame member that is adapted to be connected to one side wall of said extremity debridement trough means and to extend outwardly therefrom a selected distance at which point said rigid frame member turns back and extends to the other side wall of said extremity debridement trough means where said same member is adapted to connect to said side wall such that said rigid frame member defines an open area between itself and said extremity debridement trough means and wherein that defined open area is adpated to received the formed bag type funnel structure.

3. The extremity debridement trough of claim 2 wherein said extremity debridement trough means includes a series of clip means for engaging said disposable plastic liner of said sterile field means and generally securing the disposable plastic liner to said extremity debridement trough means.

4. The extremity debridement trough of claim 1 wherein said vertical support means includes a lower frame structure having wheel means secured thereto and a vertical support member interconnected between said lower frame structure and said debridement trough means.

5. The extremity debridement trough of claim 4 wherein said vertical support member includes means for adjusting the height of said debridement trough means and wherein said adjustment means includes first and second telescoping sections that may be adjusted with respect to each other to position debridement trough means at a selected height.

6. The extremity debridement trough of claim 4 including means for movably mounting said debridement trough means relative to said vertical support member for allowing said debridement trough means to be moved between an inoperative vertical transport position where the said trough means extends along the side of said vertical support member to an operative horizontal position where the debridement trough means extends generally normal to said vertical support member.

7. The extremity debridement trough of claim 1 wherein said means for pivotly mounting said side walls to the bottom of said debridement trough means includes a hinge assembly operatively interconnected between the bottom of said debridement trough means and each of said side walls.

8. The extremity debridement trough of claim 1 wherein said debridement trough means includes an extension means that extends outwardly from said debridement trough means for resting upon a support structure such as an operating table.

9. The extremity debridement trough of claim 1 wherein said debridement trough means includes a pair of ends and said bottom includes a top side and an underside and wherein there is provided means for pivotably connecting the underside of said bottom to said vertical support means at a point off set from the center of said debridement trough means adjacent one end thereof such that said debridement trough means can be conveniently pivoted from a horizontal operative position to an inoperative vertical position for storage or transport.

10. The extremity debridement trough of claim 1 wherein said lower frame structure of said vertical support means includes a container formed therein for holding selected articles such as cushions.

11. The extremity debridement trough of claim 1 wherein the same is designed to be used in conjunction with a table, such as an operating table, having subject thereon, and wherein said debridement trough means includes a bottom extension that extends outwardly from the bottom of said debridement trough means past the side walls thereof for extending onto said table whereby said table acts to support said extremity debridement trough and debridement trough means thereof when said debridement trough means is disposed in a generally horizontal operative position.

12. An extremity debridement trough for receiving and holding a wounded extremity of a patient while the wounded extremity is cleaned and treated in a sterile field; said extremity debridement trough comprising:

a. debridement trough means for receiving and holding a wounded extremity or a patient;

b. said debridement trough means including a bottom and opposed side walls pivotally mounted to said bottom to form a trough-like structure wherein said side walls are movable from an operative generally upstanding position inwardly to an inoperative position generally overlying said bottom;

c. said debridement trough means further including an extremity insert end that includes an opening formed about one end of said debridement trough means for allowing an extremity of a patient to be inserted therethrough onto said extremity debridement trough means and a funnel end for allowing cleaning and irrigation solutions to be drained from said debridement trough;

d. stop means for limiting the outward pivotal movement of said side walls once said side walls assume an operative upstanding position;

e. a funnel support frame structure extending outwardly from said funnel end of said debridement trough, said frame structure extending between opposite sides of said debridement trough and defining an open area between funnel support from structure and said debridement trough;

f. sterile field means normally held and disposed within said debridement trough means about the bottom thereof and between the opposed side walls thereof for underlying an extremity of a patient contained therein and for holding and confining a wound cleaning and irrigation solution used in cleaning the wound of the extremity;

g. said sterile field means including an impervious disposable plastic liner that is supported by said extremity debridement trough means and which generally lies therein with the patient's extremity supported thereon, said plastic liner including a funnel, having an outlet, secured to and depending downwardly from said funnel support structure through said open area for directing said cleaning and irrigation solutions to a container disposed thereunder;

h. clip means for engaging said disposable plastic liner of said sterile field means and generally securing the disposable plastic liner to said extremity debridement trough means;

i. vertical support means secured to said extremity debridement trough and extending downwardly therefrom to a support surface such as a floor for supporting said extremity debridement trough above the support surface;

j. said vertical support means including a lower frame structure having wheel means secured thereto and a vertical support member interconnected between said lower frame structure and said debridement trough means, said vertical support member including first and second telescoping sections that may be adjusted with respect to each other to position said debridement trough means at a selected height; and k. means for movably mounting said debridement trough means relative to said vertical support member for allowing said debridement trough means to be moved between an inoperative vertical transport position where said debridement trough means extends along the side of said vertical support member to an operative horizontal position where said debridement trough means extends generally normal to said vertical support member.

* * * * *